US006044782A

United States Patent [19]

Fressemann et al.

[11] Patent Number: 6,044,782

[45] Date of Patent: Apr. 4, 2000

[54] BOBBIN HOLDER FOR A SEWING MACHINE

[76] Inventors: Debra D. Fressemann, 909 1st St. SE., Waverly, Iowa 50677; Ricky R. Drape, 23418 Twin Point Ave., Hutchinson, Minn. 55350

[21] Appl. No.: 09/113,898

[22] Filed: Jul. 13, 1998

[51] Int. Cl.[7] ..... D05B 43/00

[52] U.S. Cl. ..... 112/270; 112/168; 112/302

[58] Field of Search ..... 112/302, 270, 112/217.1, 1, 168, 163

[56] References Cited

U.S. PATENT DOCUMENTS

| | | | |
|---|---|---|---|
| 1,822,765 | 9/1931 | Dickey . | |
| 1,956,338 | 4/1934 | Bartling . | |
| 2,910,026 | 10/1959 | Ajouelo | 112/270 |
| 3,182,926 | 5/1965 | Imnof | 112/302 X |
| 3,213,815 | 10/1965 | Russmann . | |
| 5,347,942 | 9/1994 | Thomas . | |
| 5,441,003 | 8/1995 | Hashiride | 112/168 X |
| 5,447,109 | 9/1995 | Karaba et al. . | |
| 5,694,873 | 12/1997 | Wu | 112/302 |
| 5,829,711 | 11/1998 | Wu | 112/302 X |
| 5,913,485 | 6/1999 | Bruffett | 112/302 X |

*Primary Examiner*—Ismael Izaguirre
*Attorney, Agent, or Firm*—Patent & Trademark Services; Joseph H. McGlynn

[57] ABSTRACT

A holder for sewing machine bobbins containing thread which will be used with a serger. The holder has an aperture with a grommet therein that will fit the spindle on any brand of serger and will secure the holder on the serger. The holder also includes a plurality of spindles which will hold the sewing machine bobbins, and a cover with apertures through which the threads can be extended to connect to the serger.

6 Claims, 2 Drawing Sheets

BOBBIN HOLDER FOR A SEWING MACHINE

BACKGROUND OF THE INVENTION

This invention relates, in general, to a holder for sewing machine bobbins containing sewing thread, and, in particular, to a holder for sewing machine bobbins to be used on a serger.

DESCRIPTION OF THE PRIOR ART

In the prior art various types of thread holders have been proposed. For example, U.S. Pat. No. 1,822,765 to Dickey discloses an attachment for a sewing machine which allows different color threads to be used.

U.S. Pat. No. 1,956,338 to Bartling discloses a plurality of ceramic eyelets mounted on a support for guiding and protecting threads.

U.S. Pat. No. 3,213,815 to Russmann discloses a spool holder for a sewing machine which holds spools on a threaded rod by means of a spring and a wing nut.

U.S. Pat. No. 5,347,942 to Thomas discloses a thread feeding device for a multi-needle sewing machine which utilizes guide channels for directing the threads to the needles.

U.S. Pat. No. 5,447,109 to Karaba et al discloses a thread control mechanism for a multi-needle sewing machine.

While the use of multiple threads for sewing machines is well known in the prior art, none of these inventions relate to serges, specifically small projects on a serger. The normal large spools of threads used on conventional sergers are impractical to use on small projects. This is especially true if the user wants to change colors frequently or if different colors and/or thread types are necessary for different projects in order to achieve a desired look. The present invention permits a user to place sewing machine bobbins on a holder which can then be placed on a standard serger and used instead of the large standard serger cones of thread.

SUMMARY OF THE INVENTION

The present invention is directed to a holder for sewing machine bobbins containing thread which will be used with a serger. The holder has an aperture with a grommet therein that will fit the standard spindle or post on any brand of serger and will secure the holder on the serger. The holder also includes a plurality of spindles or posts which will hold sewing machine bobbins, and a cover with apertures through which the threads on the bobbins can be extended to connect to the serger.

It is an object of the present invention to provide an economical holder for bobbins used with a serger.

It is an object of the present invention to provide a holder for bobbins used with a serger that will fit all brands of sergers.

It is an object of the present invention to provide a holder for bobbins used with a serger that will provide professional serging results.

These and other objects and advantages of the present invention will be fully apparent from the following description, when taken in connection with the annexed drawings.

DESCRIPTION OF THE PREFERRED EMBODIMENT

Figure 1:
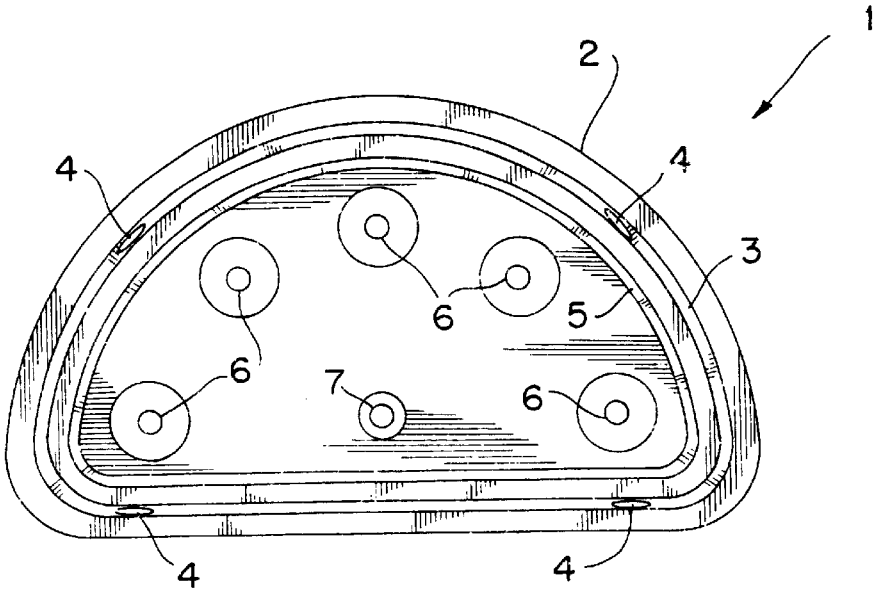
FIG. 1 is a top view of the base of the present invention.
Figure 4:
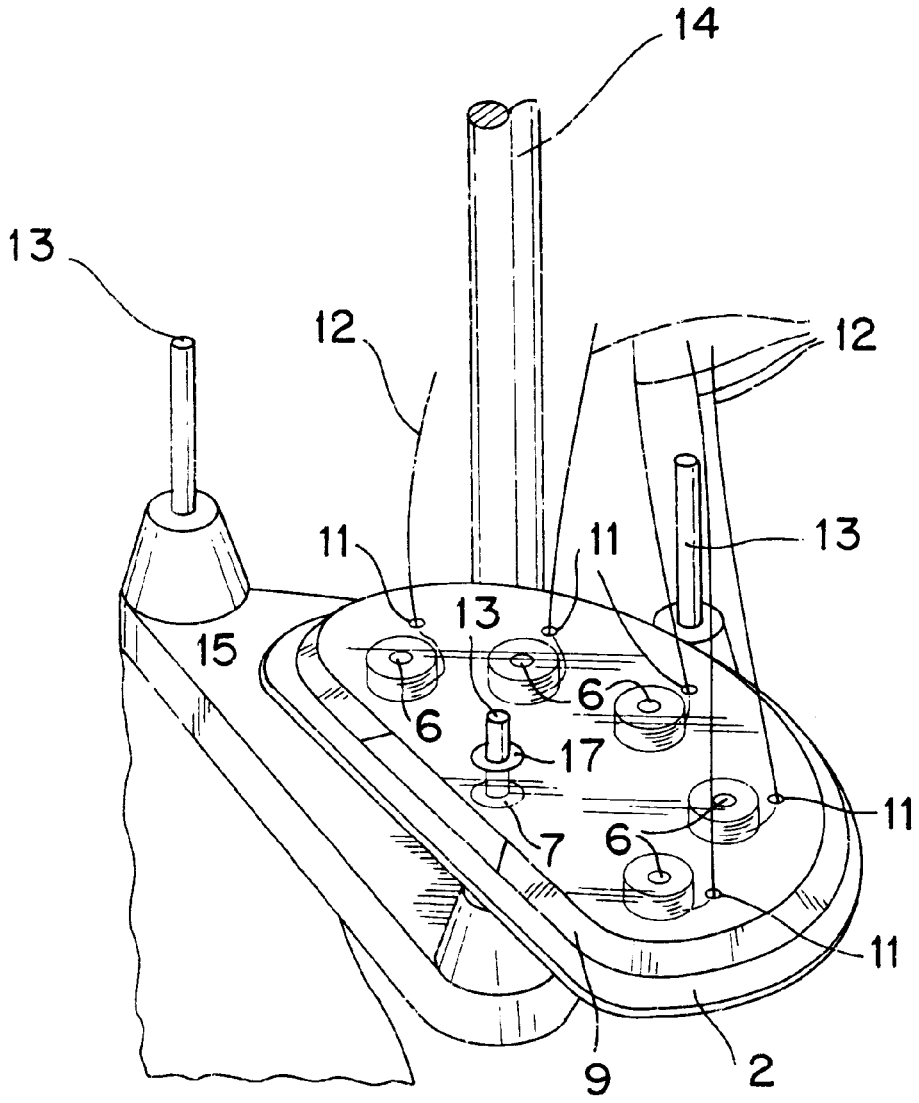
FIG. 4 is a partial perspective view of the present invention attached to a serger.

Referring now to the drawings in greater detail, FIG. 1 shows the base of the bobbin holder of the present invention. The holder has a base 2 (see also FIG. 2) and upstanding wall 3 which surrounds the base 2. Inside the wall 3 is a plurality of posts 6 which can be molded unitary with the base or can be separate pieces which are attached to the base in any conventional manner. The diameter of the posts 6 will hold a sewing machine bobbin, as shown in FIG. 4. The base or bottom 2 also has an aperture into which is secured a rubber grommet 7, which as shown in FIG. 4, will receive the standard posts or spindles 13 which will normally hold the large cones of thread (not shown) which are generally used on sergers.

Figure 2:
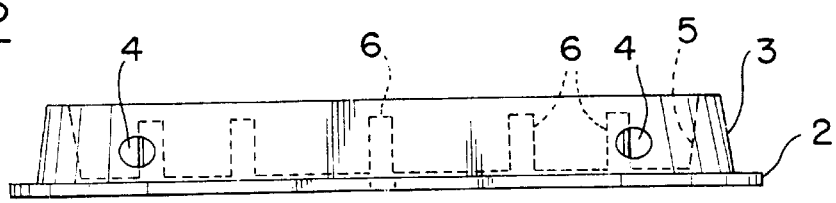
FIG. 2 is a side view of the base of the present invention.

As shown in FIGS. 1 and 2, the upstanding wall 3 has a plurality of apertures 4 spaced therearound. These apertures 4 will cooperate with projections 10 (see FIG. 3) to hold the cover 9 onto the base 2 by snapping into the apertures 4 when the cover is placed on the base. The cover will hold the bobbins in place and protect them from dust or dirt. The projections 10 are mounted on an upstanding wall 16 that will fit around the wall 3 on the base 2. As the cover 9 is pushed onto the upstanding wall 3, the walls 3, 16 will have enough resiliency to allow the projections to expand outwardly as they are placed over the wall 3 and then to snap into the apertures 4 as they become aligned with these apertures. In addition, the cover can be transparent so the user can see the color of the threads wound onto the bobbins 15.

Figure 3:
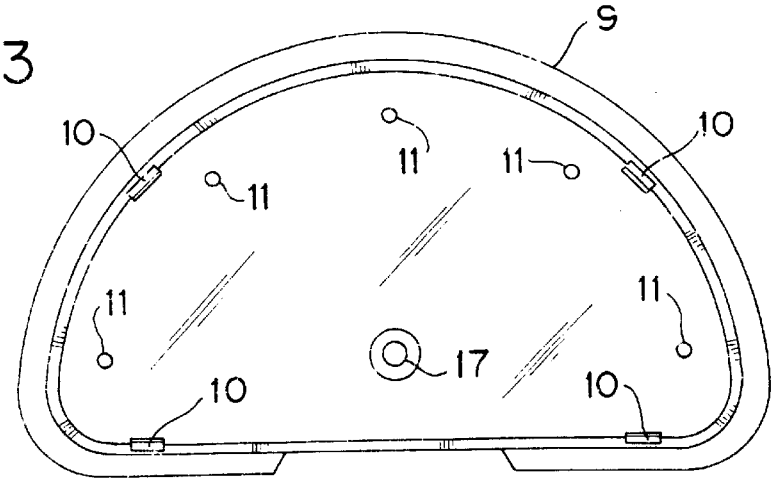
FIG. 3 is a bottom view of the cover of the present invention.

As can be seen in FIGS. 3 and 4, the cover has a plurality of apertures 11 extending therethrough. After the bobbins 15 are placed on the posts 6, the threads 12 on the bobbins can be passed through the apertures 11 and then connected to the serger thread post 14 in the normal manner. An aperture in the cover with a grommet 17 (see FIG. 3) will receive one of the posts 13 (as shown in FIG. 4) which normally holds the large spools of serger thread. The rubber grommets 17 and 7 will allow the present invention to be used with any type of serger regardless of the size of the post 13.

In use, when a person wants to use the serger for small projects, such as basket liners, alterations, doll clothing, tee shirts, shorts or children's attire, which do not require large amounts of thread, the holder 1 of the present invention will be loaded with bobbins 15 which contain sewing machine thread. The bobbins can contain different colors of thread to coordinate with the material the thread will be used on, and a user can pre-loaded a plurality of holders with different types or color of thread so it will be easy to change holders as they move from one small project to another. In addition, decorative threads can be loaded onto the bobbin allowing for decorative or embellishment types of sewing and serging.

The thread 12 will be passed through the apertures 11 if they have not already been passed through the apertures. Then the holder will be placed onto one of the posts 13 of the serger by passing the aperture 7, in the base 2 of the holder, over the post 13 until the end of the post 13 comes through the aperture 12 in the cover 9. Now all that is necessary is to thread the serger with the threads 12 in the normal manner and serge away.

Although the Bob 'N Serge and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What we claim as our invention is:

1. A holder for a plurality of bobbins which contain thread and which are adapted to be used with a serger, said holder comprising:

a base having a bottom and at least one upstanding wall, said base having a plurality of posts extending upward from said bottom, means on said upstanding wall for securing a cover thereto, an aperture extending through said bottom, and wherein said means on said upstanding wall for securing a cover thereto is a plurality of apertures.

2. A holder for a plurality of bobbins which contain thread and which are adapted to be used with a serger, said holder comprising:

a base having a bottom and at least one upstanding wall, said base having a plurality of posts extending upward from said bottom, means on said upstanding wall for securing a cover thereto, an aperture extending through said bottom, and wherein said aperture in said bottom has a grommet therein.

3. A holder for a plurality of bobbins which contain thread and which are adapted to be used with a serger, in combination with a cover, said holder comprising:

a base having a plurality of posts extending upward from said bottom, means on said upstanding wall for securing a cover thereto, an aperture extending through said bottom, and wherein said cover has a top and a wall depending from said top, said wall on said cover having means for cooperating with said means on said upstanding wall on said base for securimg said cover to said base.

4. The holder for a plurality of bobbins as claimed in claim 3, wherein said means on said wall for cooperating with said means on said upstanding wall on said base is a plurality of projection.

5. The holder for a plurality of bobbins as claimed in claim 3, wherein said cover has a plurality of apertures extending therethrough.

6. The holder for a plurality of bobbins as claimed in claim 5, wherein said cover has at one additional aperture extending therethrough, said at least and one additional aperture having a grommet therein.

* * * * *